United States Patent [19]

Melocik et al.

[11] 4,362,089

[45] Dec. 7, 1982

[54] VALVE SYSTEM

[75] Inventors: Kurt B. Melocik, Mazon; Robert W. Earley, Minooka, both of Ill.

[73] Assignee: Caterpillar Tractor Co., Peoria, Ill.

[21] Appl. No.: 245,228

[22] PCT Filed: Jun. 16, 1980

[86] PCT No.: PCT/US80/00766

§ 371 Date: Jun. 16, 1980

§ 102(e) Date: Jun. 16, 1980

[87] PCT Pub. No.: WO81/03689

PCT Pub. Date: Dec. 24, 1981

[51] Int. Cl.[3] ..... F15B 11/16

[52] U.S. Cl. ..... 91/461; 137/113; 137/505.18; 91/436

[58] Field of Search ..... 137/111, 112, 113, 505.18, 137/625.6, 625.63, 106, 101; 251/26; 91/461, 436, 438

[56] References Cited

U.S. PATENT DOCUMENTS

| | | | |
|---|---|---|---|
| 868,219 | 10/1907 | Pietzuch et al. | 137/505.18 |
| 3,103,230 | 9/1963 | Kutschie | 137/116.3 |
| 3,576,194 | 4/1971 | Christensen | 137/118 |
| 3,703,850 | 11/1972 | Honeycutt | 91/446 |
| 3,766,944 | 10/1973 | Distler | 137/625.6 |
| 3,840,049 | 10/1974 | Field, Jr. | 137/625.63 |
| 3,874,269 | 4/1975 | Walters | 91/433 |
| 3,987,703 | 10/1976 | Latimer | 91/6 |
| 4,240,457 | 12/1980 | Riediger | 137/101 |

*Primary Examiner*—William R. Cline

*Attorney, Agent, or Firm*—Wegner, Stellman, McCord, Wood & Dalton

[57] ABSTRACT

A fluid power control system (17) having an improved control valve (20) providing reduced regulated pressure fluid selectively from a high pressure pump supply (P) or the fluid motor (10) under conditions wherein the pump supply has failed to supply the desired pressurized fluid. The system utilizes a control valve (20) having a spool (29) provided with first transfer passage (41) and second transfer passage (42). The first transfer passage is adjustably throttled as a result of movement of the spool relative to an adjacent inlet port (37) and the second transfer passage (42) is adjustably throttled by movement of the spool relative to an adjacent inlet port (38). Inlet port (37) is connected to the high pressure fluid supply P and inlet port (38) is connected to the head end (13) of the cylinder (11) of the fluid motor through a check valve (44). Valve (20) provides selective pressure regulated fluid through an outlet port (36) thereof either from the pressurized fluid supply P when that apparatus is functioning or from the fluid motor in the event of a failure of the fluid supply. In each case, the valve provides the fluid at a desired operating pressure. The pressure regulated fluid may be used to operate a pilot valve (22) controlling a main valve (14) for adjustably positioning the piston (12) of the fluid motor.

8 Claims, 3 Drawing Figures

FIG. 2
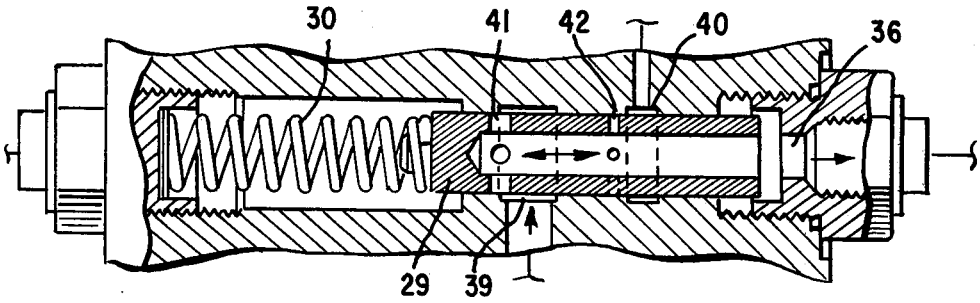
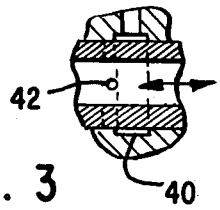
FIG. 3

VALVE SYSTEM

DESCRIPTION

1. Technical Field

This invention relates to valve systems, and in particular to pressure regulating valves for use in load controls.

2. Background Art

In one conventional system for controlling a fluid motor, such as used in lifting a load in a vehicle such as an earthworking machine, fluid pressure is delivered to a piston cylinder through a main control valve which is conventionally controlled by a pilot valve. The pressurized fluid is provided from a suitable high pressure pump which is driven when the apparatus is in operation. It is desirable to provide a pressure regulating means for regulating the pressure of the fluid delivered to the pilot valve, and for this purpose, pressure regulating valves have conventionally been employed.

The regulated pressure fluid is delivered to the pilot valve for modulation thereby in effecting the shifting of the main valve to provide the desired control of the fluid motor.

At times, it is necessary to operate the fluid motor in the absence of fluid pressure from the pump. Thus, at times, it may be desirable to lower the load at the time of an engine failure and the pressure source is de-energized such that the normal control of the piston cylinder is no longer available. To permit the controlled lowering of the load under such conditions, it has been conventional to provide a selector and a second valve which is arranged to provide controlled fluid pressure to the pilot valve by suitably controlling the fluid relieved from the piston cylinder.

A number of fluid systems have been developed for use in controlling such loads. Illustratively, in U.S. Pat. No. 3,703,850, of Don R. Honeycutt, a hydraulic control system is disclosed utilizing dump valves controlled by the hydraulic fluid of the system for removing from the system returning hydraulic fluid so as to eliminate the need for delivering the returning fluid back through a substantial length of the system and thereby providing a faster response time.

In U.S. Pat. No. 3,766,944, Josef Distler shows a pilot controlled fluid flow regulating valve wherein the pressure reducing signal is developed by a pilot valve. The flow regulating valve has a chamber receiving pressurized fluid from the pump through a pilot valve for moving the spool of the regulating valve from a neutral position to an intermediate position and thereupon to any one of several operative positions. A control piston is displaced by a manually operated handle in effecting the desired control of the fluid system.

In U.S. Pat. No. 3,840,049, of Jesse L. Field, Jr., which patent is owned by the assignee hereof, a fluid motor control system is provided having a float position. The control valve includes a spool and means for selectively shifting the spool in response to fluid pressure signals from a manually operated pilot valve. The valve has make-up valve means which automatically opens a bypass passage between the fluid motor ports and fluid return passage when necessary to prevent cavitation of the motor such as during an overrunning condition from the external load force. In the Field, Jr. patent, the spool of the pilot valve has four positions, including a float position interconnecting the two motor ports and the fluid return passage so that the motor may move in either direction, as determined by external load forces. The pilot valve is anually actuated and utilizes a smaller pool than that of the directional valve.

In a second U.S. Letters Patent owned by the assignee hereof, Eugene E. Latimer discloses, in U.S. Pat. No. 3,987,703, a hydraulic control system wherein the load lifting hydraulic motor is controlled from a source of pressurized fluid through a pilot-operated directional control valve having a combined restrictor and shuttle valve assembly. This assembly is operative to direct pressurized fluid from the pump for pilot operation of the main control valve when the pump is in operation. However, upon failure of the pump system to provide the desired pressure, the assembly provides an emergency source of hydraulic fluid for operation of the main control valve in the form of the load-generated pressure in the head ends of the implement jacks. This pressure is utilized to supply pressurized fluid to the pilot valve and is accomplished by automatic shifting of the shuttle valve by the spring biasing thereof as a result of an absence of pressure from the pump.

DISCLOSURE OF INVENTION

The present invention comprehends an improved valve system wherein a pressure regulating valve is arranged to provide the selective regulation of fluid pressure delivered from the pump pressure source or from the load during a down condition of the pump.

The valve system is arranged to provide the alternate regulated fluid control automatically in the event of failure of the pump or failure of provision of the normal pressurized fluid for any reason.

Thus, the present invention is directed to overcoming one or more of the problems of the background art fluid pressure systems discussed above.

In one aspect of the present invention, a pressure regulating valve has a body, a chamber in the body, an inlet port and an outlet port communicating with the chamber, a valve member slidably positioned within the chamber and being movable between a first position at which the inlet port is in unrestricted communication with the outlet port and a second position at which the inlet port is in variable communication with the outlet port for reducing and regulating the pressure of the fluid passing from the inlet port to the outlet port, and means for resiliently biasing the valve member to the first position. The valve member is moved to the second position in response to the fluid passing through the inlet port to the outlet port. The body has a second inlet port in communication with the chamber and is in communication with the outlet port at the first position of the valve member. The valve member is movable to an intermediate position at which the second inlet port is in variable communication with the outlet port for reducing and regulating the pressure of the fluid passing from the second inlet port to the outlet port. The valve member is moved to the intermediate position in response to fluid passing through the second inlet port and in the absence of fluid passing through the first inlet port to the outlet port.

In the illustrated embodiment, the biasing means urges the movable valve member to the first position in response to a failure of provision of the pressurized fluid normally controlling the disposition of the movable valve member by delivery thereof through the first inlet port.

In the illustrated embodiment, the movable valve member comprises a spool. In the illustrated embodiment, the outlet passage opens through one end of the spool and the biasing means acts against the opposite end of the spool.

The invention comprehends the use of the valve in a fluid power control system having a fluid motor connected to a load to be moved, fluid supply means for providing pressurized fluid for operating the fluid motor, a pilot controlled valve means for controlling operation of the fluid motor, pressure regulating valve means including a movable valve member and defining an outlet for providing fluid from the valve means at a reduced regulated pressure for operating the pilot controlled valve means, means for selectively connecting the pressure regulating valve means to the fluid supply means with the valve member in one pressure regulating disposition to provide fluid from the valve means to the pilot controlled valve means at a regulated pressure and connecting the valve means to the fluid motor with the valve member in another pressure regulating disposition to provide fluid from the fluid motor to the pilot controlled valve means at a regulated pressure in the event the load is in an extended condition and the fluid supply means is not providing the desired pressurized fluid.

Thus, the invention comprehends an improved fluid power control system having an improved, selectcr-pressure regulating valve for providing suitable regulated fluid from a plurality of different sources. The selection of control is effected automatically as a result of a failure of one of the sources to provide the desired fluid pressure. The valve is advantageously adapted for use in a fluid power control wherein a load is lifted as it provides improved means for permitting controlled, lowering of the load notwithstanding a failure of the high pressure pump at a time when the load is in a raised condition.

The apparatus of the present invention is extremely simple and economical of construction while yet providing the highly desirable features discussed above.

BRIEF DESCRIPTION OF DRAWING

FIG. 2 is a fragmentary section of the control valve illustrating the arrangement thereof in the normal control mode; and FIG. 3 is a fragmentary section illustrating the arrangement of the spool in effecting pressure regulation in controlling the fluid delivery from the fluid motor in the alternate mode of operation of the control valve.

BEST MODE FOR CARRYING OUT THE INVENTION

Figure 1:
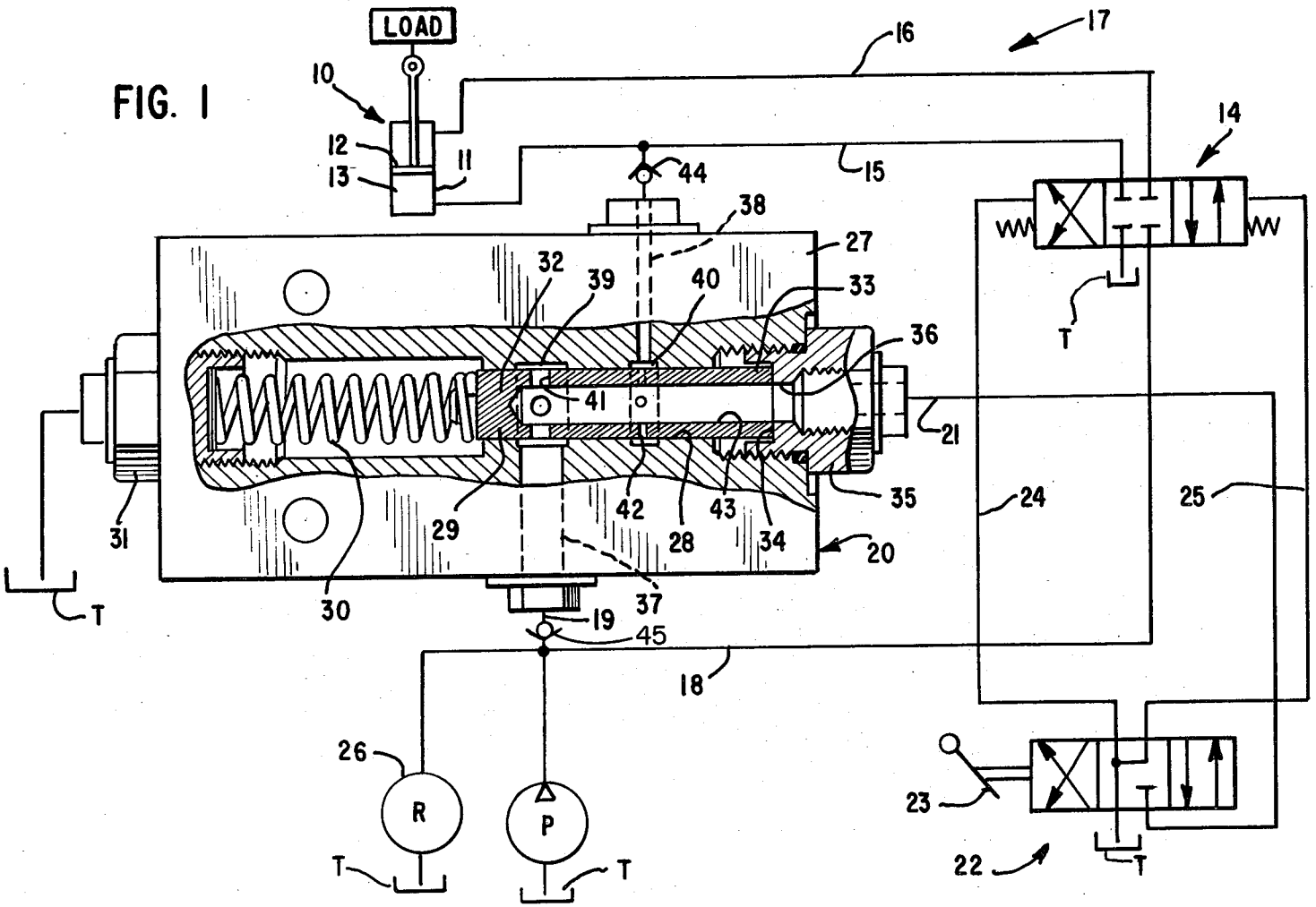
FIG. 1 is a schematic illustration of a fluid power control system having an improved control valve embodying the invention.

In the illustrative embodiment of the invention as disclosed in the drawing, a load is positioned by a fluid motor 10 illustratively comprising a cylinder 11 having a movable piston 12 therein and defining a head end 13 to which pressurized fluid is introduced to move the piston 12 in lifting the load. The pressurized fluid is delivered to the cylinder from a main valve 14 through a high pressure supply line 15 and a return line 16.

The fluid power control system generally designated 17 normally utilizes pressurized fluid delivered from a source, such as pump P. The pump receives fluid from a return tank T and provides the fluid under a high pressure to a first supply line 18 connected to the main valve 14 and through a second supply line 19 to a control valve 20 embodying the invention. The control valve, in turn, provides a reduced regulated pressure fluid supply through a transfer line 21 to a pilot valve 22. The pilot valve includes a manually operable control handle 23 so as to provide suitable pressurized fluid through lines 24 and 25 for operating the main valve suitably to move the piston 12 upwardly or downwardly to correspondingly raise or lower the load, as desired. As shown in FIG. 1, the main valve is also connected to the tank to complete the fluid circuit.

As shown in FIG. 1, the pump may be provided with an associated relief valve 26 for limiting the maximum pressure. As further shown, pilot valve 22 may be connected also to tank T.

In the illustrated embodiment, control valve 20 is provided with a wall means such as a body 27 defining a valve chamber 28 in which is received a movable valve member 29 which, in the illustrated embodiment, comprises a spool.

The spool is biased on one direction, i.e., to the right, as seen in FIG. 1, by a spring 30 which extends between a removable plug 31 threaded to the wall means 27, and end 32 of the spool. The opposite end 33 of the spool is urged by spring 30 into abutment with a shoulder 34 on a plug 35 threaded into the wall means at the outer end of the valve chamber 28 and defining an outlet port 36 at the outer end of the valve chamber. As illustrated in FIG. 1, the outlet port 36 is connected through the transfer line 21 to the pilot valve 22.

The wall means 27 further defines a first inlet port 37 and a second inlet port 38 opening to the valve chamber 28 in axially spaced relationship. As shown in FIG. 1, first inlet port 37 opens through an annular recess 39 to chamber 28 and second inlet port 38 opens through an annular recess 40 to the valve chamber.

The movable valve spool 29 is provided with a first transfer passage 41 adjacent recess 39 and a second transfer passage 42 adjacent recess 40. In the illustrated embodiment, the transfer passages 41 and 42 are defined by an array of radially opening, angularly spaced bores so as to provide a balanced fluid flow about the valve spool. As shown in FIG. 1, the spool is provided with an axial outlet passage 43 opening through the end 33 so as to be in communication at all times with the outlet port 36 and with the transfer passages 41 and 42.

A check valve 44 is provided between the inlet port 38 and supply line 15 to prevent fluid flow outwardly through the inlet port 38 when high pressure fluid is being delivered form pump P to control valve 20.

In normal operation, the high pressure fluid from pump P is delivered through inlet port 37 and transfer passage 41 to the outlet port 43. The pressure of the fluid acts to urge the spool 29 to the left, as seen in FIG. 2, so as to cause the transfer passage 41 to be controlledly throttled at the lefthand end of the recess 39. Illustratively, as the pressure of the fluid increases, the spool 29 moves further to the left against the biasing action of spring 30, thereby further throttling the fluid flow and reducing the pressure thereof. Alternatively, when the pressure drops, spring 30 urges the spool to the right so as to align the transfer passage 41 more fully with the inlet port recess 39 so as to decrease the throttling effect. The reciprocal movement of the valve spool thusly acts as a pressure regulating means in providing to outlet port 36 fluid for delivery to the pilot valve 22 and main valve 14 at a reduced preselected regulated pressure, permitting the pilot valve to be operated by means of handle 23 so as to provide the desired operation of main valve 14 in controlling the disposition of the fluid motor piston 12, as discussed above.

As shown in FIG. 2, when the pump is providing the high pressure fluid through the inlet recess 39 to the transfer passage 41, the spool 29 is moved sufficiently to the left to disalign the second transfer passage 42 relative to the second inlet port recess 40. Thus, the valve 20 functions simply as a pressure regulating valve under these conditions.

However, in the event that a failure of pump P occurs wherein the pressurized fluid is not delivered through the inlet port 37 to overcome the biasing action of spring 30, the spring urges spool 29 to the right, such as to the maximum position illustrated in FIG. 1 wherein the end 33 of the spool abuts shoulder 34 of the valve body plug 35. In this arrangement, the second transfer passage 42 is aligned with the recess 40 and, thus, fluid communication is permitted between the outlet port 43 and the inlet port 38, which, as indicated above, is connected to the head portion 13 of the cylinder 11 by supply line 15 and check valve 44. Thus, if the load is raised at the time the failure of pump P occurs, the fluid pressure within head end 13 causes the fluid to pass therefrom through supply line 15, check valve 44, inlet port 38, recess 40 and transfer passage 42 into the outlet port 43 of spool 29.

As illustrated in FIG. 3, the pressure of the fluid so delivered from head end of cylinder 11 will tend to react against the biasing action of spring 30 so as to move the spool 29 back to the left and cause partial disalignment of the transfer passage 42 with the recess 40 so as to provide a pressure regulating function substantially in the same manner as discussed above relative to the movement of transfer passage 41 with respect to the recess 39. Thus, the delivery of fluid from the outlet passage 43 through outlet port 36 and transfer line 21 to the pilot valve 22 is maintained at a reduced regulated pressure and permits operation of the pilot valve and main valve in the same manner as when the pump P was providing the high pressure fluid to the control valve, thereby permitting operation of handle 23 to effect a controlled lowering of the load. As seen in FIG. 1, a check valve 45 is provided in the conduit 19 leading from inlet 37 to prevent backflow of fluid through passage 41 during such lowering of the load.

INDUSTRIAL APPLICABILITY

The fluid power control system 17 is applicable to a wide range of fluid motor applications wherein it is desired to return a load to a rest position by controlled movement thereof notwithstanding a failure of the normal high pressure fluid supply. In the illustrated embodiment, the system is shown in connection with a fluid motor which raises and lowers a load, such as the bucket of an earthworking vehicle. As will be obvious to those skilled in the art, the control system is advantageously adapted for use with a wide range of different fluid motor-mode applications.

While specific pump and regulated pressures may be as desired, in the illustrated application, the regulated pressure may be approximately 2413 kPa (350 psi), with the pump pressure being approximately 13790 kPa (2000 psi). Where the load is a raised load, such as that of a bucket, the pressure in head end 13 of cylinder 11 may be substantially equal to the 13790 kPa normal pressure from pump P, while yet the control valve 20 automatically reduces and regulates the pressure delivered to the pilot valve from the head end 13 of cylinder 11 under such conditions to approximately the desirable regulated 2413 kPa pressure.

Thus, control valve 20 effectively defines a selector-pressure regulating and reducing valve, permitting a single valve member to serve both functions of providing pressure regulated fluid from the normal pump high pressure supply, or from the fluid motor during conditions where a failure of the pump supply occurs. As indicated above, the valve 20 is arranged to automatically effect the alternative functioning under these different conditions.

The invention provides the improved functioning in a single control valve 20, eliminating the need for separate valves and other system components, thereby substantially reducing the cost and minimizing space requirements so as to be advantageously adaptable for use in vehicles and the like.

Other aspects, objects and advantages of this invention can be obtained from a study of the drawings, the disclosure and the appended claims. The foregoing disclosure of specific embodiments is illustrative of the broad inventive concepts comprehended by the invention.

What is claimed is:

1. A pressure regulating valve (20) comprising:

wall means (27) defining a valve chamber (28), a first inlet port (37, 39), a second inlet port (38, 40), and an outlet port (36);

a movable valve member (29) in said chamber (28) defining a first transfer passage (41) adjacent said first inlet port (37, 39), a second transfer passage (42) adjacent said second inlet port (38, 40), and an outlet passage (43) communicating at all times with said transfer passages and said outlet port (36); and means for biasing the valve member (29) to align said first transfer passage (41) with said first inlet port (37, 39) and preselected to permit fluid pressure in said outlet passage (43) to urge said valve member (29) against the biasing action thereof to variably partially disalign said first transfer passage (41) relative to said port (37, 39) and thereby regulate the fluid pressure in said outlet passage (43), said second transfer passage (42) being disposed to be fully disaligned with said second inlet port (38, 40) when said first transfer passage (41) is so partially disaligned with said first inlet port (37, 39) and to be aligned with said second inlet port (38, 40) by said biasing means (30) in the absence of fluid pressure in said outlet passage (43), and provide adjustable communication between said second inlet port (38, 40) to said second transfer passage (42) in the absence of fluid pressure delivered to said outlet passage (43) through said first inlet port (37, 39) and thereby regulate the pressure of the fluid delivered from said second transfer passage (42) to said outlet passage (43).

2. The pressure regulating valve of claim 1, having a check valve (44) connected to the second inlet port (38, 40) for blocking fluid flow from said second inlet port (38, 40).

3. The pressure regulating valve of claim 1 for use in a fluid power control system having a load-supporting fluid motor (10), a pump (P), a pilot-operated directional control valve (14) for controlling fluid flow between the pump (P) and the fluid motor (11), and a pilot circuit (21,24,25,22) for controlling operation of the directional control valve (14), wherein said first inlet port (37, 39) is connected to the pump (P), said outlet port (36) is connected to the pilot circuit, and said second inlet port (38, 40) is connected to the fluid motor (11).

4. The pressure regulating valve claim 3 including a check valve (44) positioned between the second inlet port (38, 40) and the fluid motor (11).

5. The pressure regulating valve of claim 1 wherein said movable member (29) comprises a spool.

6. The pressure regulating valve of claim 1 wherein said movable member (29) comprises a spool and said outlet passage (43) opens through one end (33) of the spool.

7. The pressure regulating valve of claim 1 wherein said movable member (29) comprises a spool and said outlet passage (43) opens through one end (33) of the spool, said transfer passages (41, 42) opening radially through said spool to said outlet passage (43).

8. The pressure regulating valve of claim 1 wherein said movable member (29) comprises a spool and said outlet passage (43) opens through one end (33) of the spool, said biasing means (30) comprising a spring acting on the opposite end (32) of the spool.

* * * * *